US012543865B2

(12) United States Patent
Tuominen

(10) Patent No.: US 12,543,865 B2
(45) Date of Patent: Feb. 10, 2026

(54) METHOD OF FORMING AN ORTHOPEDIC MATTRESS AND ORTHOPEDIC MATTRESS

(71) Applicant: OY SDA FINLAND LTD., Vantaa (FI)

(72) Inventor: Vesa Tuominen, Vantaa (FI)

(73) Assignee: OY SDA FINLAND LTD., Vantaa (FI)

( * ) Notice: Subject to any disclaimer, the term of this patent is extended or adjusted under 35 U.S.C. 154(b) by 540 days.

(21) Appl. No.: 17/293,627

(22) PCT Filed: Nov. 15, 2019

(86) PCT No.: PCT/FI2019/050818
§ 371 (c)(1),
(2) Date: May 13, 2021

(87) PCT Pub. No.: WO2020/099725
PCT Pub. Date: May 22, 2020

(65) Prior Publication Data

US 2022/0007850 A1 Jan. 13, 2022

(30) Foreign Application Priority Data

Nov. 16, 2018 (FI) ..... 20180129

(51) Int. Cl.
*A47C 27/06* (2006.01)
*A47C 31/12* (2006.01)

(52) U.S. Cl.
CPC ..... *A47C 31/123* (2013.01); *A47C 27/062* (2013.01)

(58) Field of Classification Search
CPC ..... A47C 31/123; A47C 27/062; A47C 27/06
See application file for complete search history.

(56) References Cited

U.S. PATENT DOCUMENTS 5,515,168 A * 5/1996 Dudkiewicz ..... G06V 10/44 702/158
5,956,525 A * 9/1999 Minsky ..... A41H 1/02 33/15
6,256,820 B1 * 7/2001 Moser ..... A47C 27/064 5/721
7,178,187 B2 * 2/2007 Barman ..... A47C 27/064 5/256

(Continued)

FOREIGN PATENT DOCUMENTS

AU 20120216517 9/2012
CN 105496085 4/2016

(Continued)

OTHER PUBLICATIONS

Decision to Grant a Patent issued on Jul. 12, 2022 in corresponding Japanese Application No. 2021-526356, 3 pages.

(Continued)

*Primary Examiner* — Justin C Mikowski
*Assistant Examiner* — Ifeolu A Adeboyejo
(74) *Attorney, Agent, or Firm* — Nixon & Vanderhye PC

(57) ABSTRACT

The invention relates to a method for manufacturing an orthopedic mattress and to an orthopedic mattress. In the method, strategic measuring points of a future user of the mattress are determined. The springing is determined according to the build of the person using the mattress on the basis of a method in which the build dimensions of the mattress user are determined at strategic points.

14 Claims, 5 Drawing Sheets

(56) References Cited

U.S. PATENT DOCUMENTS

| | | | | |
|---|---|---|---|---|
| 7,184,047 | B1 * | 2/2007 | Crampton | G06T 17/00 348/592 |
| 7,677,541 | B2 * | 3/2010 | Ahn | A47C 23/00 267/179 |
| 9,504,336 | B2 * | 11/2016 | Dodd | A47C 19/025 |
| 10,598,242 | B2 * | 3/2020 | Thomas | F16F 1/08 |
| 10,820,716 | B1 * | 11/2020 | Antinori | A47C 27/062 |
| 2004/0128773 | A1 | 7/2004 | Barber | |
| 2006/0042016 | A1 | 3/2006 | Barman et al. | |
| 2008/0097779 | A1 * | 4/2008 | Rawls-Meehan | A47C 7/027 705/304 |
| 2008/0201856 | A1 | 8/2008 | Howard | |
| 2009/0062693 | A1 * | 3/2009 | Woolfson | G01F 17/00 600/587 |
| 2011/0224510 | A1 * | 9/2011 | Oakhill | A61B 5/4815 600/301 |
| 2013/0031726 | A1 * | 2/2013 | Demoss | A47C 27/064 267/180 |
| 2013/0081207 | A1 * | 4/2013 | Cohen | B68G 9/00 267/143 |
| 2014/0026328 | A1 * | 1/2014 | Jorgensen | A47C 27/064 5/720 |
| 2015/0029189 | A1 * | 1/2015 | O'Mahoney | A47C 31/123 345/420 |
| 2015/0359349 | A1 | 12/2015 | Eigenmann et al. | |
| 2016/0244319 | A1 | 8/2016 | Habertag et al. | |
| 2016/0249744 | A1 * | 9/2016 | Eigenmann | A47C 27/064 5/655.8 |
| 2016/0292319 | A1 * | 10/2016 | Thomas | A61B 5/1079 |
| 2017/0340134 | A1 * | 11/2017 | Piraino | A47C 27/08 |
| 2019/0246803 | A1 * | 8/2019 | Jewett | A47C 27/062 |
| 2019/0269251 | A1 * | 9/2019 | Eigenmann | A47C 27/062 |
| 2020/0018370 | A1 * | 1/2020 | DeMoss | F16F 3/02 |
| 2021/0045540 | A1 * | 2/2021 | Jewett | A47C 27/064 |
| 2021/0059424 | A1 * | 3/2021 | Yang | A47C 27/07 |
| 2021/0068553 | A1 * | 3/2021 | Nygren | A47C 27/061 |

FOREIGN PATENT DOCUMENTS

| | | |
|---|---|---|
| EP | 3 649 899 | 5/2020 |
| GB | 687767 | 2/1953 |
| GB | 2522452 | 7/2015 |
| GB | 2558932 | 7/2018 |
| JP | 2008-511391 | 4/2008 |
| KR | 20180020465 | 2/2018 |
| NL | 2013708 | 10/2016 |
| WO | 2006/026062 | 3/2006 |
| WO | 2012/160508 | 11/2012 |
| WO | 2013/079118 | 6/2013 |

OTHER PUBLICATIONS

Extended European Search Report issued on Jun. 24, 2022 in corresponding European Application No. 19884031.6, 8 pages.
International Search Report for PCT/FI2019/050818 mailed Feb. 14, 2020, 6 pages.
Written Opinion of the ISA for PCT/FI2019/050818 mailed Feb. 14, 2020, 7 pages.
International Preliminary Report on Patentability for PCT/FI2019/050818 dated Feb. 5, 2021, 11 pages.
Search Report for FI20180129 dated Jun. 13, 2019, 2 pages.
May 26, 2023 Office Action issued in Australian Patent Application No. 2019378116, pp. 1-7.

* cited by examiner

Front image of person

Side image of person

METHOD OF FORMING AN ORTHOPEDIC MATTRESS AND ORTHOPEDIC MATTRESS

This application is the U.S. national phase of International Application No. PCT/FI2019/050818 filed Nov. 15, 2019 which designated the U.S. and claims priority to FI Patent Application No. 20180129 filed Nov. 16, 2018, the entire contents of each of which are hereby incorporated by reference.

BACKGROUND OF THE INVENTION

The present invention relates to a method of forming an orthopedic mattress and an orthopedic mattress formed by the method.

From prior art a method is known where a person places themselves on a measuring mattress, and based on a surface pressure, springing is individually determined so that a sleeper's spine is straight when sleeping.

SUMMARY OF THE INVENTION

The present patent application puts forth a new method in which springing is determined according to the build of the mattress user, based on an imaging method in which the mattress user's build dimensions are determined at strategic locations over the shoulders, below the shoulders with hands spread out, at a femur end, at the stomach, and the dimensional number values in question of the person from the front.

In addition, a person is defined from a side; measurement values from various height points.

In the method according to the invention, the definition of strategic body points takes place, in an embodiment of the invention, by measuring mechanically. A body chart is formed from strategic measuring points. Measuring and definition points include the locations of the shoulder joints of a sleeper's shoulders, as well as the locations of the hip joints.

In a second embodiment, the body chart is formed by an imaging method. A reference with known dimensions, such as an A4 paper sheet, is placed on the chest of the person being measured so that the measured person keeps a dimensional reference, such as the sheet of paper, on the chest by hand. The reference and the person are imaged and, based on the image, the locations of the strategic points are determined for the person in question. When the dimensions of the reference are known, the locations of the strategic points, such as the location of the shoulders, of the person behind the imaged dimensional reference can be determined on the mattress and thus the springing, too.

In imaging, a camera is advantageously used.

Based on the image taken, springing is determined for the person in question.

In connection with a person's front of rear image, there is automatically a raster grid which indicates the exact locations of the strategic points on the body of the future user of the mattress, such as the shoulder joints and hip joints.

An embodiment is additionally feasible where the locations of a person's strategic points, such as the shoulder area, are determined from the image by measuring the distances from the dimensional reference, such as a plate or a rectangular or square sheet of paper.

Once the locations of a person's strategic points from the front or rear, and also the side, are obtained, springing for the mattress of the imaged person can be determined.

On the basis of the strategic measuring points from the front or rear, an depression depth of each spring on the mattress is determined, and on the basis of the outer dimensions of the person's body and aforementioned strategic measuring points, a surface pressure the mattress was subjected to is determined at the different measuring points of the person, and consequently the stiffness of the spring system.

The cross-sectional form of a person H is an approximate ellipse. Based on the surface area of the ellipse, it is possible to calculate over a distance of 3 cm of length, for example, the surface pressure that the body creates on the mattress by knowing that body density is approximately 800 kg/cubic metres. The loading on a loading area having the width of a spring (3 cm) is between the values of 3 kp and 8 kp. The ellipse may be determined by measuring the vertical and horizontal axes of the ellipse at each height point of the sleeper.

Based on the dimensioning/imaging of the person, the springing may be determined. Shoulders, for example, require a larger depression depth whereas the centre area of the mattress at the waist and chest a smaller depression depth and stiffer springing that straightens the spine. This way, an orthopedic mattress, straightening the posture is achieved. In addition, a person's weight and weight distribution play a role in the stiffness requirement of the springs. A heavier user needs stiffer springs.

Springing for the mattress at the shoulders, for example, is formed of springs that are softened and stiffened by changing the pitch angle of the spring coils.

The mattress may be softened, that is, the elastic coefficient reduced, and the depression depth simultaneously increased by reducing the pitch angle of the spring coil. In the similar manner, the spring in question may at specific locations be stiffened by increasing the pitch angle of the spring coil in question at certain locations.

By carrying out said measures on one and the same spring, a softening of the mattress at shoulders, for example, is achieved and a larger depression depth, and nevertheless at the bottom of the elasticity an adequate stiffness and support in the same spring.

Areas with different pitches in the spring coil may be at different ends of the spring, or the more elastic section of the spring may be located at the middle of the spring, for example.

The use of a reference in imaging may also be realized with the aid of a phone application. In the application, the mattress buyer measures themselves by using a sheet of paper, such as an A4, as the reference. The buyer acts according to the shooting instructions the application provides and takes, for example, three images, two from the front and one from the side.

The images and measurement result are sent to a mattress manufacturer or a representative thereof through the mobile application. An order agreement is made on a detailed mattress with the same application.

The application sends a confirmation to the ordering party once the measurement result is confirmed as having succeeded. In an embodiment of the method according to the invention, an application is therefore used in which measurement information is sent in a wired or wireless manner on a person using the mattress to a mattress manufacturer or their representative.

Advantageously three images are sent, in which a reference such as a sheet of A4 paper is imaged at the height of a person's chest, at the person's thighs, and from the side at the person's thighs. The dimensions of the A4 paper sheet are precisely known in advance, and the critical strategic dimensions of the person in the images at the shoulder, below the shoulders, at the stomach, and the locations of the femur and top end of the femur and the hip fulcrum are obtained by measuring/comparing the distance between the reference and the strategic point.

Based on the person's side image and image or images taken from the front or rear, the stiffness and depression depth required by the springing can be determined at different points along the length of the orthopedic mattress.

The method of manufacturing an orthopedic mattress and an orthopedic mattress according to the invention are characterized by what is disclosed in the claims.

BRIEF DESCRIPTION OF THE DRAWINGS

In the following, the invention is described with reference to preferred embodiments of the drawings, to which the invention is not meant to be exclusively restricted.

LIST OF FIGURES

Figure 1A:
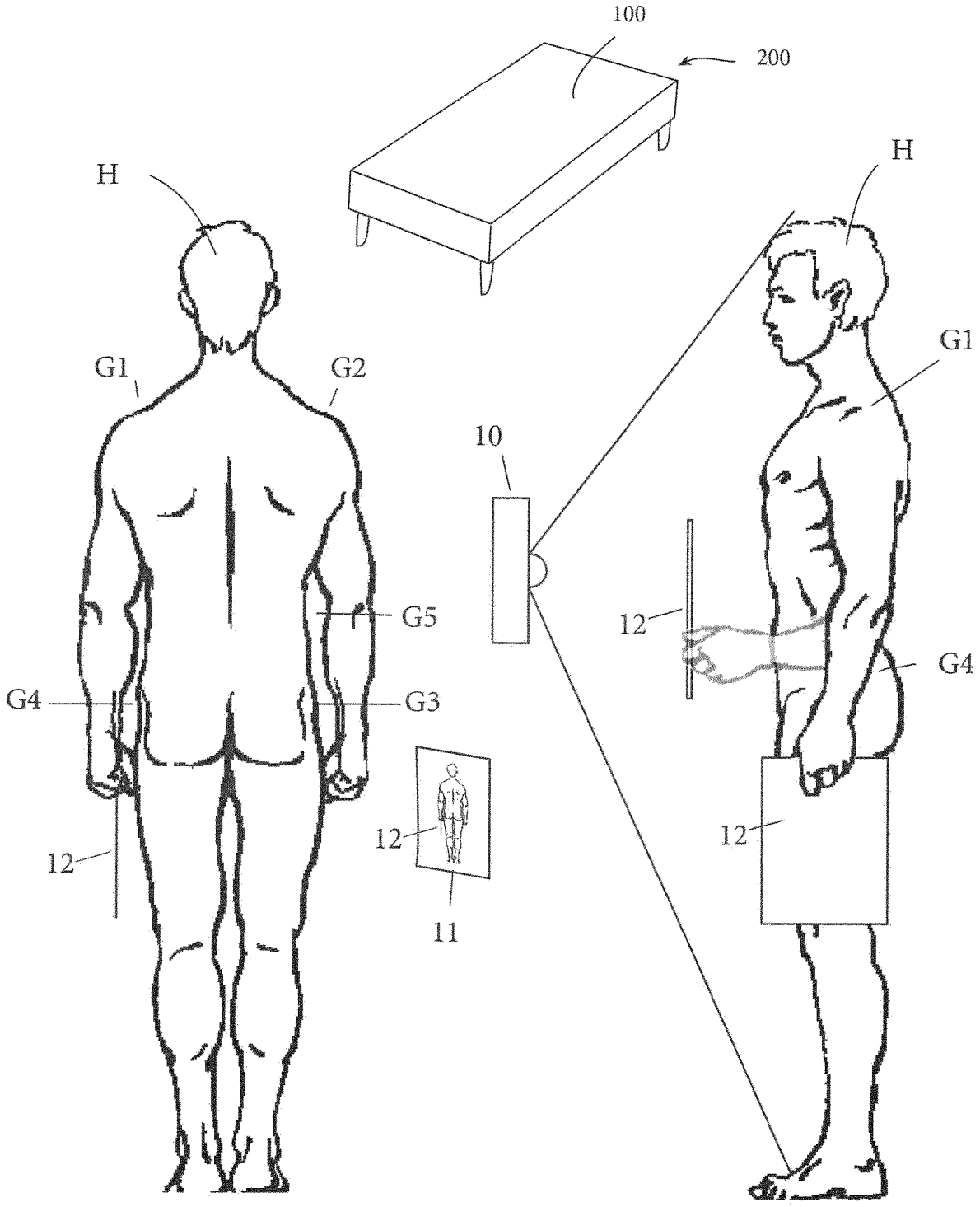

FIG. 1A illustrates the method according to the invention and the imaging method for determining springing for a mattress according to the build of a future user of the mattress.

Figure 1B:
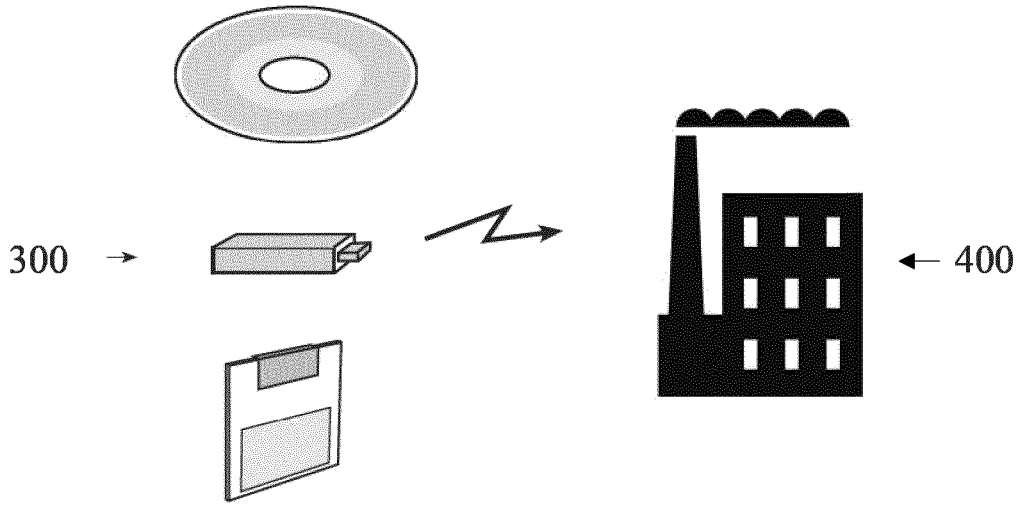

FIG. 1B illustrates image transfer from a mattress customer to a mattress factory.

Figure 1C:
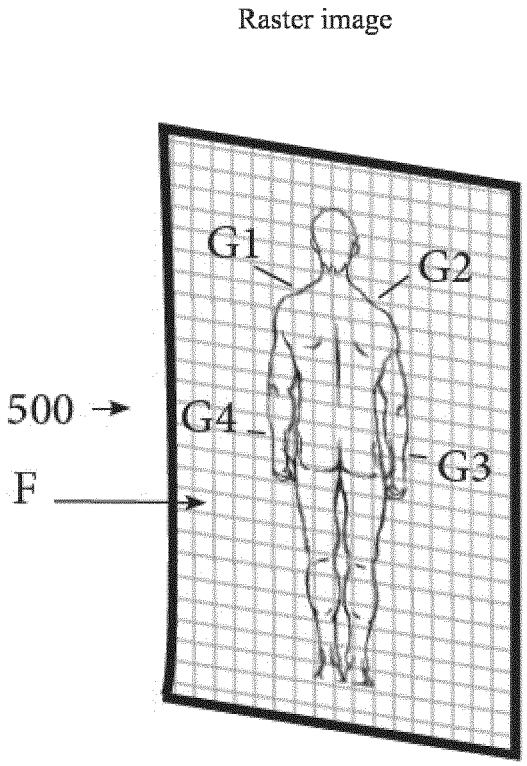

FIG. 1C a raster image taken with a special application of a future user of the mattress.

Figure 2A:
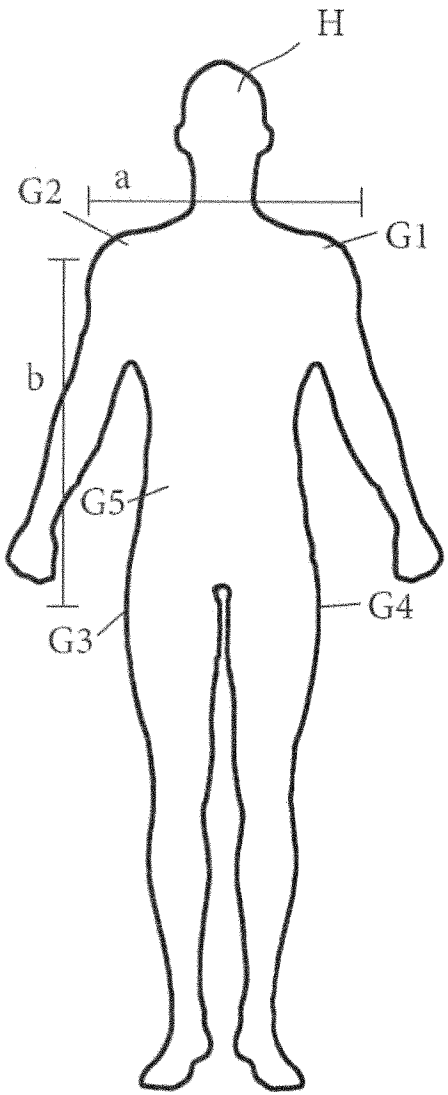
Figure 2B:
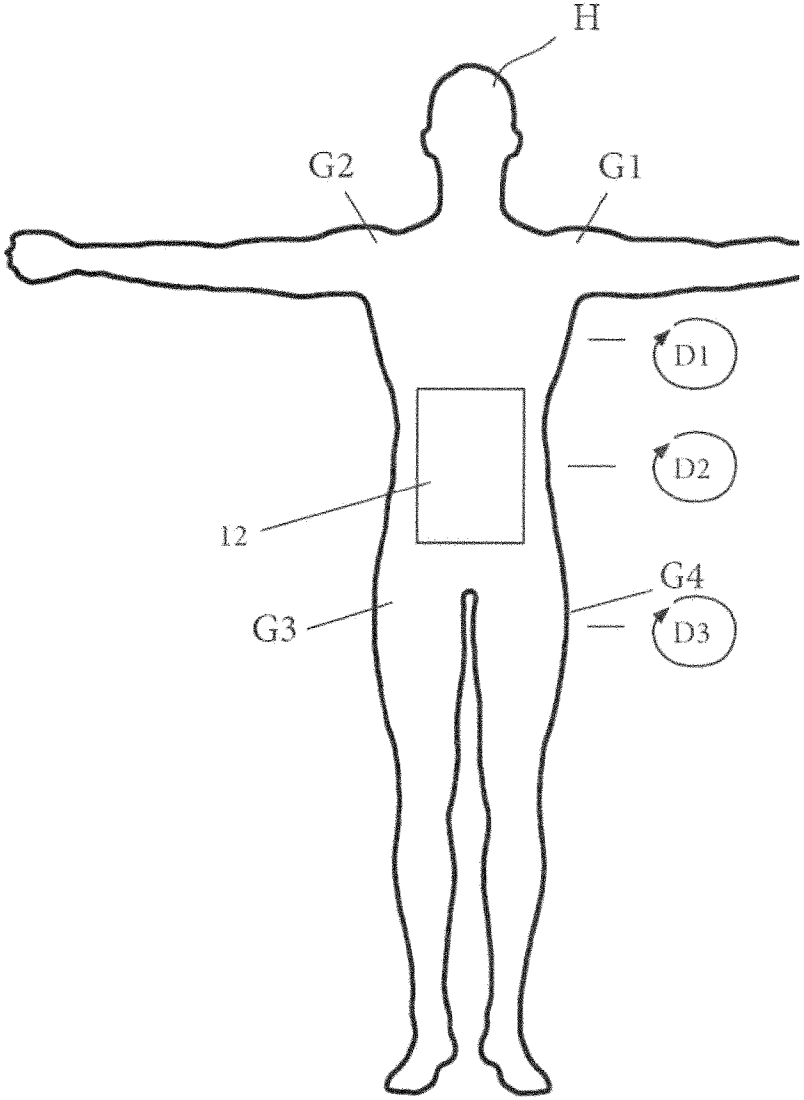

FIGS. 2A and 2B show measuring points i.e. strategic points of a mattress user.

FIG. 2A shows a person from the front with the hands down.

FIG. 2B shows a person from the front with the hands raised.

Figure 3A:
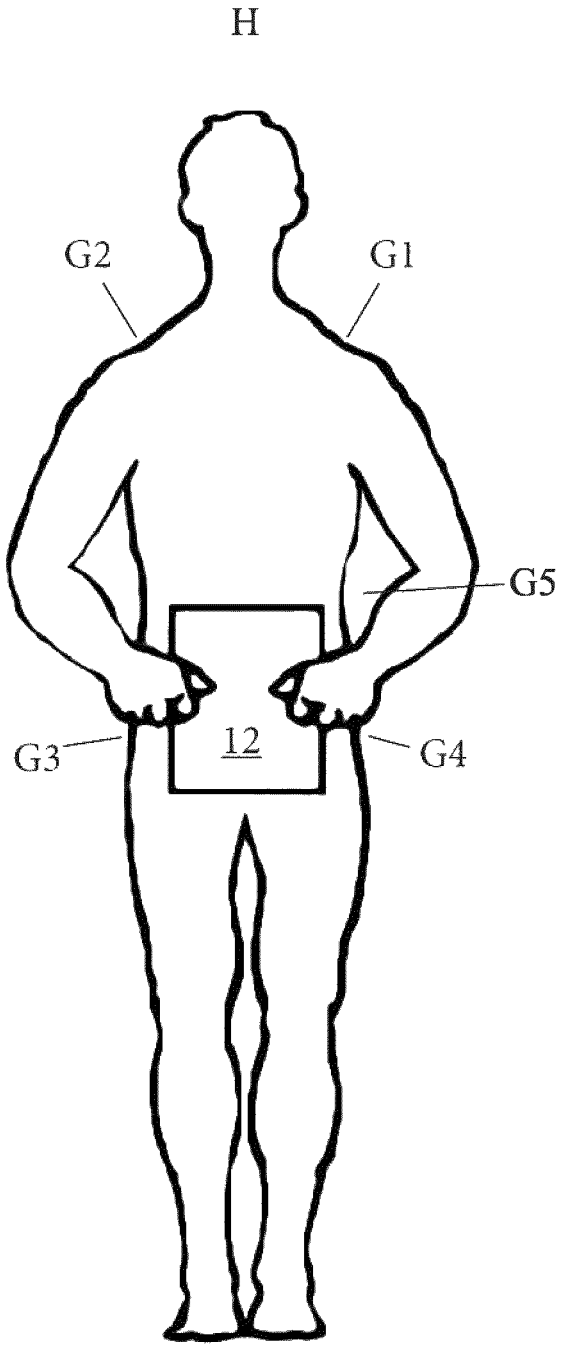

FIG. 3A shows an imaging point from the front at chest level, and an A4 sheet of paper as a dimensional reference. The figures show how a person holds the sheet of paper in their hands during imaging.

FIG. 3A is a front image of a person.

Figure 3B:
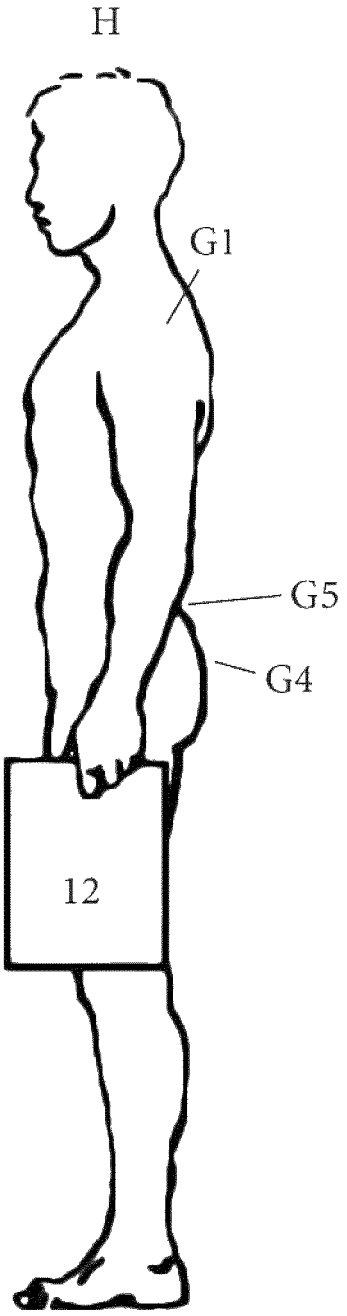

FIG. 3B is a side image and a dimensional reference at a thigh.

Figure 4:
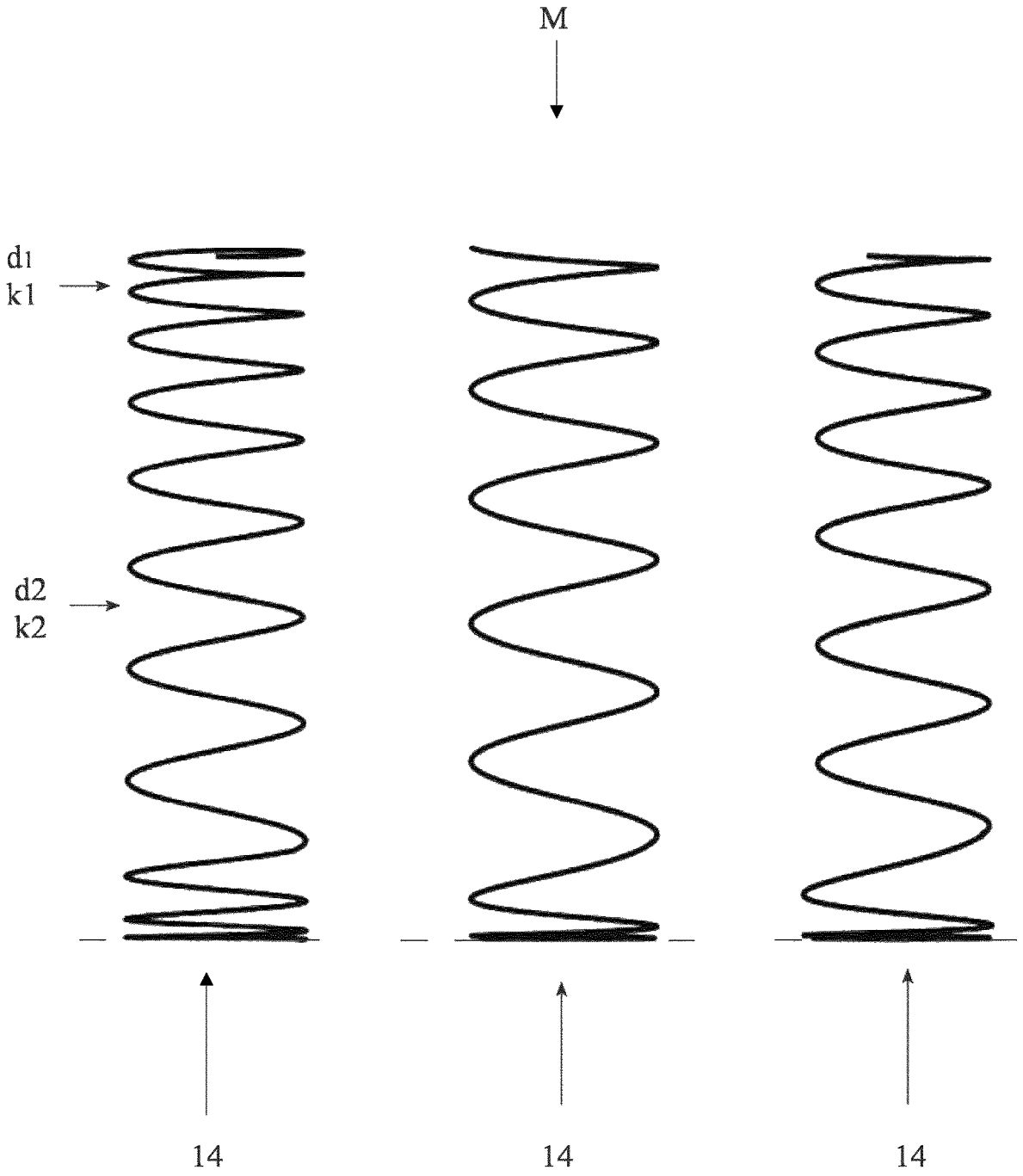

FIG. 4 shows a structure of a spring in a spring system of an orthopedic mattress dimensioned and formed with the method according to the invention.

DETAILED DESCRIPTION OF THE INVENTION

FIG. 1A illustrates the method according to the invention. An image 11 is taken of the person for whom the mattress with the springing will be made with a device 10. The device 10 may be a mere camera, mobile phone, tablet, or another device capable of taking the image to be saved or sent on immediately or with delay. An image is taken of the person from the front with a dimensional reference 12 at the chest, and from the front with the dimensional reference 12 at the thighs, and from a side of the person. Two or three images are advantageously taken, whereby one or two images are taken from the front and at least one from the side. The images are used to determine the locations of the strategic points on the user's body, such as those of the shoulders G1, G2 and femurs and hip joints G3 and G4, and the waist G5.

In an image 500 formed, there may be a grid to determine the person's dimensions.

A mobile phone application may be used and switched to the camera mode to take selfie photos of oneself by following the instructions provided by the application.

In addition, the invention allows using a method where a separate dimensional reference 12 is used in connection with a person's image. The dimensional reference 12 is advantageously a sheet of paper, such as an A4. The precise dimensions of the sheet are known, and based on them points on the person's body, such as the shoulders, waist etc. in the background of the image may be measured from the image 11 (FIG. 1). Based on this, the depression depth of the springs and the stiffness of the springs may be determined for the springing.

FIG. 1B illustrates image transfer from a memory device 300, such as a phone and from the memory circuit/memory circuits of its camera, memory sticks, hard discs, or rom discs to the mattress factory 400 in a wired or wireless manner.

FIG. 1C is a raster image 500 of a future user of the mattress 100 from the rear. Based on the raster grid F, the image may directly reveal the exact locations of the strategic points such as shoulder joints G1, G2, hip joints G3, G4, and the waist G5. For imaging, a mobile phone application may also be used which allows the image to directly provide distances between the imaged person's H various strategic points and their locations.

FIG. 2A shows a front image of a mattress user. The strategically important measuring locations of the person are shown. The location of the shoulder joint is denoted by reference markings G1 and G2.

The location of the femur end is denoted by reference markings G3 and G4, and the location of the stomach at the navel is denoted by the reference marking G5. When the coordinates of these points are found out by the described imaging method, and the measured person is placed in the middle of a bed 200, the springing M may be determined for a mattress 100. Strategic dimensions also include the distance a between the shoulder joints G1 and G2, and the distance b between the shoulder joint G2 and hip joint.

FIG. 2B shows a person with the hands extended to the sides. The circles D1, D2, D3 in FIG. 2B show the height locations on the body, from which the thickness of the body is examined, or an ellipse cross section of that part of the body is measured. On the basis of it, the load pressure on the mattress is calculated at the body location in question.

A person may also be measured, and a dimension chart be formed as follows:

The locations of a person's shoulder joints G1, G2 and the distance a between them, and the distance b between the shoulder joint and hip joint are measured by a measuring device or measuring tape.

The elliptic circumference of the person's body is measured at the chest, waists, and bottom. When the density of a human body is known to be approximately 800 kg/cubic metres, it is possible to calculate the load on the mattress at different height points of the person over e.g. 5 cm distances and at different width points of the mattress.

The springs 14 may be selected from a spring storage or manufactured as needed.

FIG. 3A shows taking the first image from the front at the chest. It is taken by using an A4-sized sheet of paper as a dimensional reference 12. Its exact dimensions are known. The person H keeps the dimensional reference 12 on the chest by two hands. Based on a photo taken with a camera 10, it is possible to determine the precise locations of the strategic points G1, G2, G3, G4 of the person H using the mattress 100 on the bed 200 and therefore on the future orthopedic mattress 100, the springing M of which is formed based on the imaging of the mattress user as described in the above.

After this, a front image may be taken of the future user of the mattress, with the dimensional reference 12 at the thighs. Based on the image or images, the depression depths of the springs may be determined at different locations of the mattress. The image in which the user keeps the dimensional reference at the thighs makes it easy to measure the shoulder width of the user. The image in which the user keeps the dimensional reference on the chest in turn makes it easy to measure the body width below the armpits. This way, it is possible in a simple manner to determine how much the shoulder extends outside the line of the body. This allows determining how much larger the depression depth of the springs is at the shoulder than at the body. At the head, for example, the depression depth of the springs may be even smaller than at the body.

FIG. 3B is a side image of a future user of the mattress; the dimensional reference 12 at a thigh. Based on the side image, a person's side profile may be determined, and together with the front or back image, or images, the weight distribution along the height of the person, and on the basis of it the required springing may be determined as well as the required elasticity, that is, the stiffness of the spring at each location of the mattress.

FIG. 4 shows a spring 14 of the spring system M in the mattress 100 for the bed 200. The spring system M of the mattress is determined by using the method described in the above. There is a series of springs 14 presented. The springs 14 may be formed to be mutually of the same height. The spring 14 comprises a more sparsely coiled spring portion i.e with a smaller pitch, and thus a softer elastic portion d1, and an elastic portion d2 with a larger pitch in the spring coil, so a harder spring portion. The spring coefficient k1 of the elastic portion d1 is smaller than the spring coefficient k2 of the elastic portion d2. The spring 14 is used on the mattress 10 portions that are against the shoulder, based on the user's measuring chart, which has been obtained by an imaging method, such as by shooting with a camera 10, as shown in the preceding figures.

The shoulder area requires a larger depression depth which in the method is implemented by reducing the spring constant k by reducing the pitch of the spring coil of the spring to establish the desired depression depth. When the goal is a large depression depth, the portion of the elastic portion d1 of the smaller spring coefficient k1 is significant in the spring. To maintain good support by the spring in question, the pitch of the spring coil of the spring is increased at another location of the spring, that is, the spring coefficient k2 is increased. The more elastic area in each spring may be at one end of the spring or at both ends, or in the centre area of the spring.

The disclosed solution allows springing to be formed in any mattress provided with springs. The above means that the solution may be applied to all types of mattresses such as a removable mattress bed, frame mattress bed, yankee bed, motorized bed etc.

The depression depth of a spring in the springing M at each point of the mattress 100 is determined on the basis of a front or rear image or images taken of the mattress user H.

Based on the side thickness image or images taken of the user H together with the front and rear image or images, the orthopedic mattress has the springing stiffness determined at each location point of the spring 14.

The springs 14 of the spring system for the springing are selected from a spring storage from e.g. twenty different springs that have different depression depths and/or stiffness. The springs 14 may also be fabricated one by one as needed whereby storing the springs 14 is avoided or at least reduced.

Those skilled in the art will find it obvious that, as technology advances, the basic idea of the invention may be implemented in many different ways. The invention and its embodiments are thus not restricted to the above-described examples but may vary within the scope of the claims.

The invention claimed is:

1. A method for forming an orthopedic mattress, the method comprising:

taking a plurality of images of a future user of the mattress with a dimensional reference, such that when precise dimensions of the dimensional reference are known, a measuring chart of the user's body is determinable, the taking of the plurality of images comprising:

taking at least two front or rear images of the user so that in at least one of these images the user keeps the dimensional reference at chest height and in at least one of these images the user keeps the dimensional reference at thigh height, such that the location of the shoulder fulcrum is determined from the at least two images by comparing the at least two images, and taking at least one image of the user from a side;

determining build dimensions of the future user of the mattress at strategic measuring points, the determined build dimensions being determined for one or more first locations on and/or along the future user's body, determining, based on the determined build dimensions taken at the strategic measuring points, a required depression depth for each spring to be used in a spring system in the mattress being formed, determining outer dimensions of the future user, the outer dimensions being determined for one or more second locations around the future user's body, the first and second locations being different from one another, wherein the one or more second locations around the future user's body include a plurality of second locations around the future user's body and reflect elliptic circumferences, determining, based on the elliptic circumferences and a body density approximation of the user, a surface pressure that the future user will exert on the mattress at the different measuring points along predetermined distances and widths, determining a required stiffness of each spring to be used in the spring system in the mattress being formed, based on at least the determined surface pressure and the outer dimensions of the future user, wherein each spring to be used in the spring system in the mattress being formed is a spring coil, at least a subset of the spring coils to be used in the spring system comprising a softer portion and a harder portion, wherein, for each respective spring coil in the subset of the spring coils, a height of the softer portion is determined based on the required depression depth and a stiffness of the harder portion is determined based on the required stiffness, and forming the mattress using the springs to be used in the spring system.

2. The method as claimed in claim 1, further comprising determining a location of the femur end and the hip fulcrum of the future user of the mattress.

3. The method as claimed in claim 1, further comprising:

determining the build dimensions of the user by measuring them from the at least two front or rear images of the user, measuring the outer dimensions of the user from the at least two front or rear images of the user and from the at least one image taken from the side.

4. The method as claimed in claim 1, further comprising using a sheet of paper as the dimensional reference.

5. The method as claimed in claim 1, further comprising the user keeping the dimensional reference on the side of the thigh when the at least one side image of the user is taken.

6. The method as claimed in claim 1, further comprising transferring the images taken of the future user of the mattress in a wireless manner/wired manner/on a memory stick/memory card/memory disc from a shooter of the images to a mattress factory or its representative which manufactures the mattress based on the images taken of the user.

7. The method as claimed in claim 1, further comprising:

taking the image of the future user of the mattress by a mobile phone camera by following instructions on an application downloaded on the mobile phone, wherein the future user of the mattress or their representative sends a mattress order to a mattress manufacturer or a representative of the mattress manufacturer.

8. The method as claimed in claim 1, further comprising setting the springs of the spring system of the orthopedic mattress to the same height, wherein elasticity of at least part of at least some of the springs is such that a softer spring coil area is formed therein by reducing a pitch of the respective spring coils, the softer spring coil area being locatable at a lengthwise position of the respective springs, and wherein a stiffer area is formed by increasing the pitch.

9. The method as claimed in claim 1, further comprising selecting the springs for the spring system for the mattress from spring storage, the spring storage including springs having different depression depths and/or stiffness, or forming the springs of the spring system as needed; and using the selected or formed springs in forming the mattress.

10. The method as claimed in claim 1, wherein the build dimensions include side-to-side and top-to-bottom measurements of the user, and wherein the outer dimensions reflect thickness of the user around a plurality of areas.

11. The method as claimed in claim 1, wherein the mattress is formed from springs of the same height, wherein a given softer portion has a spring pitch reduced relative to a corresponding harder portion.

12. The method as claimed in claim 1, wherein stiffer and harder spring areas are formed in the mattress to straighten the future user's posture.

13. The method as claimed in claim 12, wherein the stiffer and harder spring areas are formed for a waist.

14. The method as claimed in claim 1, wherein one or both ends of a given spring coil is more elastic than a center section thereof.

* * * * *